US006685500B2

(12) United States Patent
Nakamura

(10) Patent No.: US 6,685,500 B2
(45) Date of Patent: Feb. 3, 2004

(54) CONNECTOR AND A METHOD OF ASSEMBLING A CONNECTOR

(75) Inventor: Hideto Nakamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/013,611

(22) Filed: Oct. 30, 2001

(65) Prior Publication Data

US 2002/0115338 A1 Aug. 22, 2002

(30) Foreign Application Priority Data

Feb. 16, 2001 (JP) ..... 2001-040822

(51) Int. Cl.[7] ..... H01R 3/00
(52) U.S. Cl. ..... 439/489; 439/352
(58) Field of Search ..... 439/489, 352

(56) References Cited

U.S. PATENT DOCUMENTS

| | | | | |
|---|---|---|---|---|
| 5,370,543 A | | 12/1994 | Hamada et al. | 439/188 |
| 5,672,073 A | | 9/1997 | Matsumura et al. | |
| 6,065,991 A | | 5/2000 | Fukuda | |
| 6,241,547 B1 | * | 6/2001 | Fukuda | 439/352 |
| 6,341,974 B1 | | 1/2002 | Konoya | 439/352 |

FOREIGN PATENT DOCUMENTS

| | | |
|---|---|---|
| DE | 197 14 459 A1 | 10/1998 |
| EP | 0 583 056 A1 | 2/1994 |
| EP | 0 841 724 A2 | 5/1998 |
| EP | 0 926 773 A1 | 6/1999 |
| EP | 0 994 532 | 4/2000 |

* cited by examiner

*Primary Examiner*—Renee Luebke
*Assistant Examiner*—Ann McCamey
(74) *Attorney, Agent, or Firm*—Anthony J. Casella; Gerald E. Hespos

(57) ABSTRACT

A connector includes a female housing (30) that can be fit into a receptacle (11) of a male housing (10). A lock arm (18) projects into the receptacle (11) and is elastically deformable in a direction intersecting the connecting direction of the housings (10, 30) between an engaging position where it is engageable with a slider (51) assembled into the female housing (30) via compression coil springs (50) and a disengaging position where it is disengaged from the slider (51). If a connecting or separating operation is interrupted halfway, spring forces accumulated in the compression coil springs (50) elastically compressed by the slider (51) are released, and the slider (51) is biased forward and the lock arm (18) located in the engaging position is pushed to forcibly separate the housings (10, 30) from each other.

14 Claims, 9 Drawing Sheets

(A)

(B)

(A)

(B)

(A)

(B)

CONNECTOR AND A METHOD OF ASSEMBLING A CONNECTOR

BACKGROUND OF THE INVENTION

1. Field of the Invention

The present invention relates to a connector with a connection detecting function and to an assembling method for such a connector.

2. Description of the Related Art

A connector with a connection detecting function is disclosed in Japanese Unexamined Patent Publication No. 11-185880 and is illustrated in FIG. 9 herein. This known connector has a female housing 1 that is connectable with a male housing 2. A lock arm 3 is provided on the female housing 1. A slider 4 is mounted in the male housing 2 and a coil spring 5 is provided at the rear wall of the male housing 2 to bias the slider forwardly. The lock arm 3 deforms elastically and pushes the slider 4 against the biasing force of the coil spring 5 while the housings 1 and 2 are being connected with one another. The lock arm 3 is restored elastically to its original shape when the housings 1, 2 are properly connected to lock the housings 1, 2 into each other. The lock arm 3 then is disengaged from the slider 4 and the slider 4 is returned to its initial position by the biasing force of the coil spring 5.

Connection could be interrupted with the housings 1, 2 only partly connected. In this situation, the coil spring 5 causes the slider 4 to push the lock arm 3 back and to separate the housings 1, 2 from each other. This separating movement, indicates that the housings 1, 2 were left partly connected.

On the other hand the housings 1, 2 may be detached from each other for maintenance or for another reason. The housing 1, 2 are disconnected by elastically deforming the lock arm 3 and then pulling the female housing 1. However, the housings 1, 2 may be left partly connected if the pulling of the female housing 1 is interrupted.

A partial connection of the housings during the separating operation cannot be detected in the conventional connectors. Therefore, connectors capable of making such a detection have been hoped for.

The present invention was developed in view of the above situation and an object thereof is to enable a partial connection detection both during a connecting operation and during a separating operation.

SUMMARY OF THE INVENTION

The invention is directed to a connector with first and second connector housings that are at least partly connectable with each other. A slider is disposed in the first connector housing and is movable forward and backward along connecting and separating directions of the connector housings. An engaging portion is provided in the second connector housing, and is resiliently or elastically displaceable in a direction that intersects the connecting and separating directions. The engaging portion is displaced to a first position engaged with the slider when the connector housings are partially connected and is displaced to a second position disengaged from the slider when the connector housings are connected completely.

The slider can be moved backward both at an intermediate stage of a connecting operation and at an intermediate stage of a separating operation with the resilient engaging portion in the first position. When the connector housings are connected properly, the engaging portion is displaced to the second position and out of engagement with the slider. Thus, the slider can be moved forward.

A biasing means is assembled into the first connector housing and urges the slider forward. The slider can be moved back against the biasing force of the biasing means both at an intermediate stage of connecting the connector housings and at an intermediate stage of separating the connector housings while the elastic engaging portion is in the first position. The biasing force accumulated in the biasing means is released when the housings are connected properly to move the slider forward.

The elastic engaging portion is in the engaging position at the intermediate stage of the connecting operation, and pushes the slider back against the force of the biasing means. If the connecting operation is interrupted at this stage, the biasing force accumulated in the biasing means is released. Thus, the forwardly biased slider pushes the elastic engaging portion to separate the connector housings. As a result, partial connection can be detected. The engaging portion is disengaged from the slider when the connector housings are connected properly. Thus, the biasing force accumulated in the biasing means is released and moves the slider forward.

The connector housings are separated from their connected condition by moving the slider back against the force of the biasing means. If the separating operation is interrupted, the forwardly biased slider engages the elastic engaging portion that has been displaced elastically from the disengaging position to the engaging position. As a result, the slider forcibly separates the connector housings, and partial connection can be detected. In this way, partial connection can be detected both during the connecting operation and during the separating operation.

The elastic engaging portion comprises a lock arm that is displaced elastically from the disengaging position to the engaging position by moving onto the first connector housing at the intermediate stage of the connecting or separating operation. The engaging portion then is displaced elastically from the engaging position to the disengaging position and engages the first connector housing to lock the connector housings into each other when the connector housings are connected properly. The construction of the connector can be simplified by also using the lock arm as the elastic engaging portion.

The elastic engaging portion engages the slider at an angle to the connecting and separating directions to prevent a displacement of the elastic engaging portion that would unlock the housings from each other.

The slider preferably comprises an operable portion for moving the slider back against the biasing force of the biasing means. The operable portion is formed to project out from the connector. Thus, the slider can be moved back easily by operating the operable portion while the connector housings are being separated from each other.

The slider preferably is located to restrict displacement of the elastic engaging portion relative to the first connector housing when the connector housings are connected properly. As a result, the connected connector housings can be held firmly.

The elastic engaging portion and the first connector housing preferably are formed with guide surfaces capable of guiding displacement of the elastic engaging portion from the disengaging position to the engaging position only when the connector housings are pulled in separating direction with at least a minimum specified force.

The connector housings can be separated by moving the slider back to a position where displacement of the elastic engaging portion is permitted and then pulling the connector housings in separating directions with at least the minimum specified force. Thus, the elastic engaging portion is guided by the guided by the guide surfaces and displaced to the disengaging position where it is disengaged from the first connector housing. As a result, the connector housings can be separated from each other. Accordingly, movement of the slider in the disconnecting direction of the first connector housing from the second connector housing allows a displacement of the elastic engaging portion that unlocks the connector housings from each other.

The invention also is directed to a method of mating first and second connector housings. The method comprises connecting the first connector housing with the second connector housing to bring an elastic engaging portion in the second connector housing into engagement with a portion of the first housing and to displace the elastic engaging portion from a position where it is not engageable with a slider along connecting and separating directions of the connector housings to a position where it is engageable with the slider along the connecting and separating directions. Thus, the slider is engaged with the elastic engaging portion and is moved back both at an intermediate stage of a connecting operation and at an intermediate stage of a separating operation. The elastic engaging portion is displaced to the disengaging position and is not engageable with the slider along the connecting and separating directions when the housings are connected properly with one another. Hence, the slider is moved forward.

These and other objects, features and advantages of the present invention will become apparent upon reading of the following detailed description of preferred embodiments and accompanying drawings.

DETAILED DESCRIPTION OF THE PREFERRED EMBODIMENT

Figure 1:
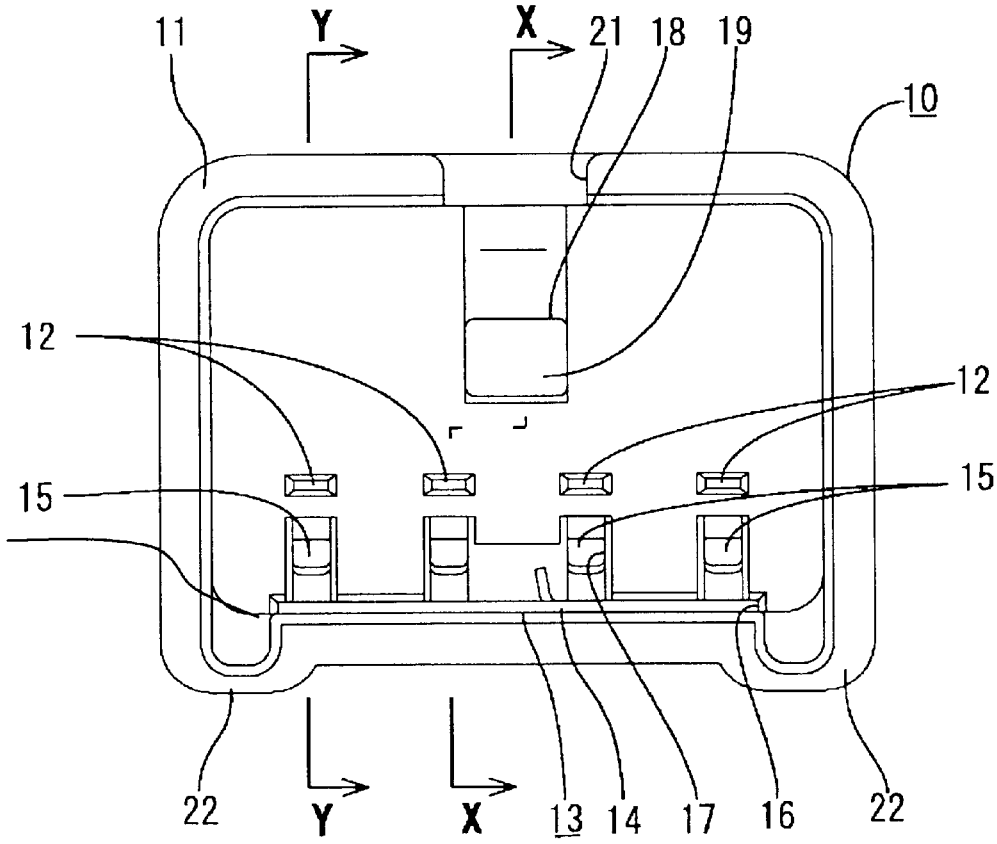
FIG. 1 is a front view of a male housing according to one preferred embodiment of the invention.
Figure 2:
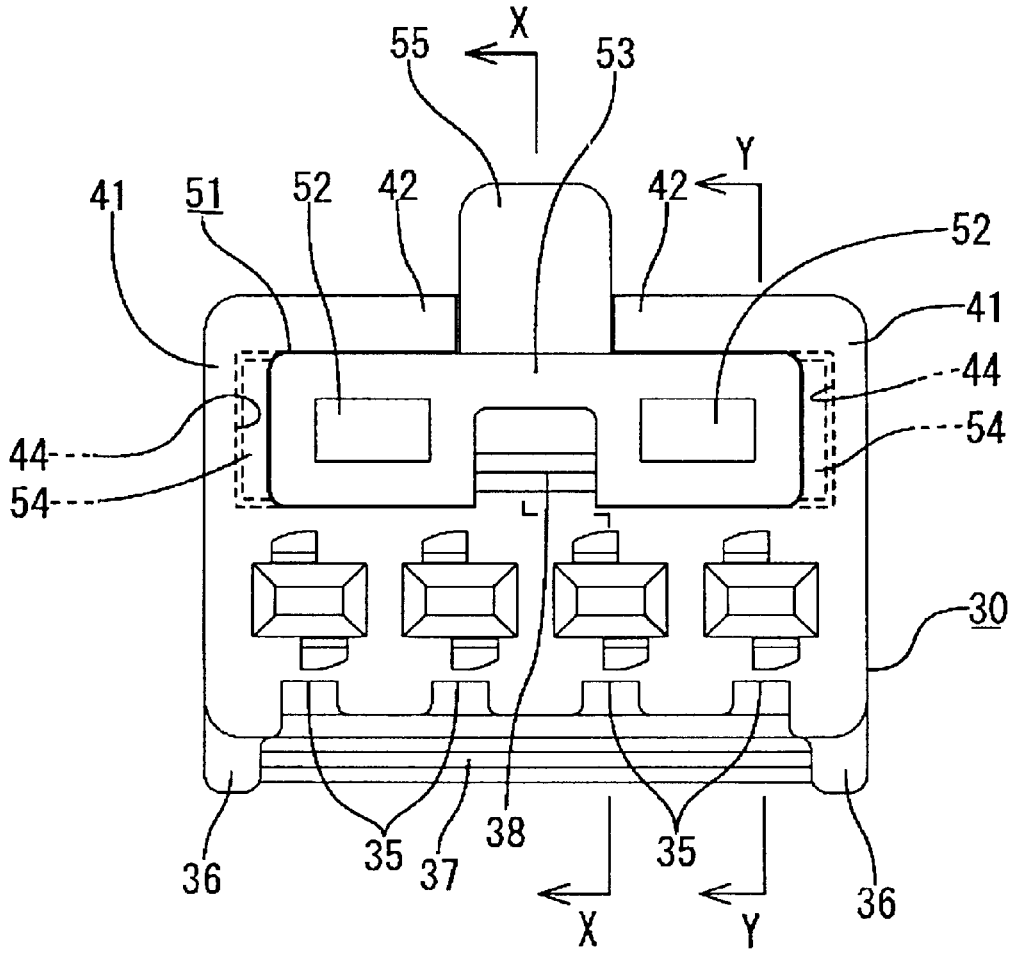
FIG. 2 is a front view of a female housing.
Figure 3:
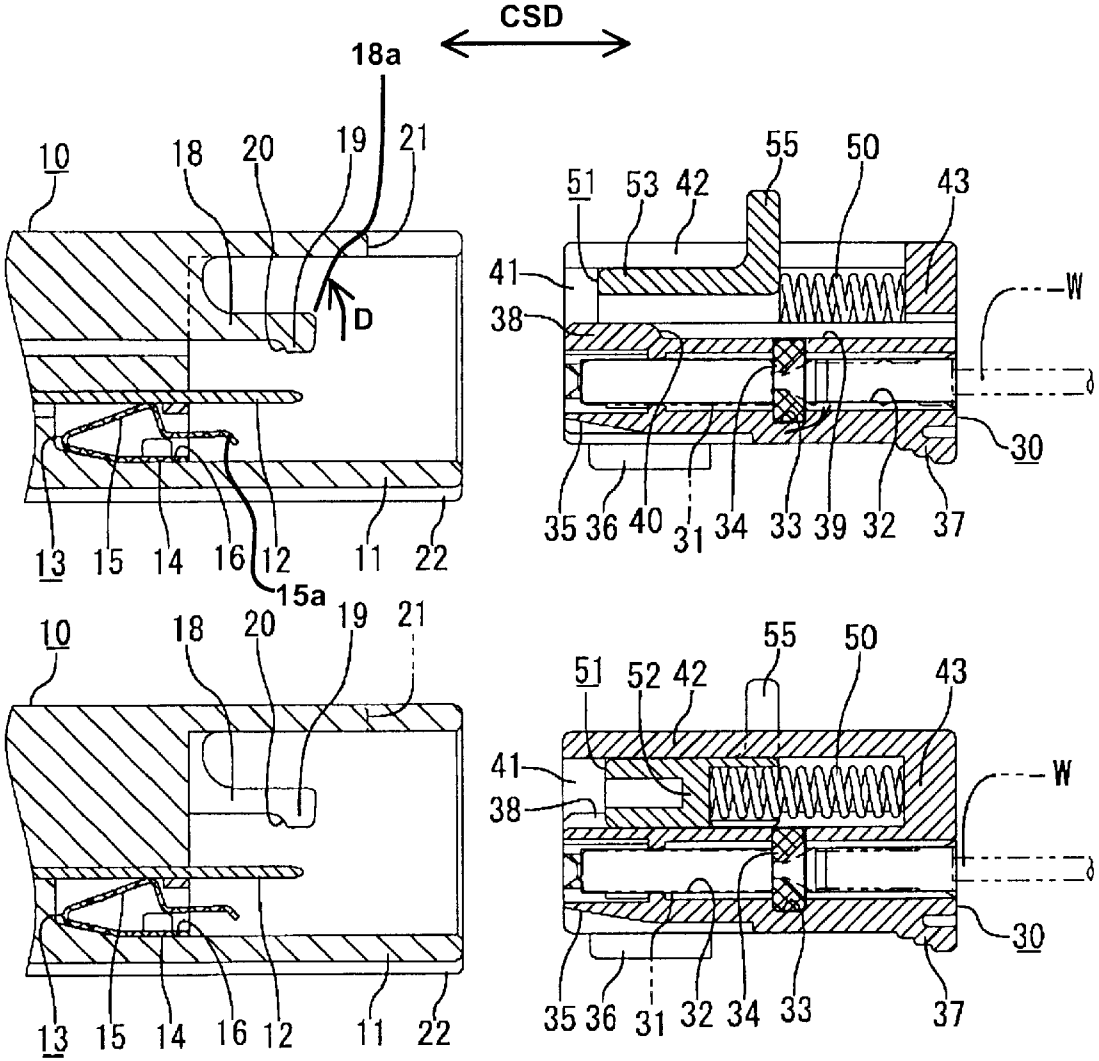
FIGS. 3A and 3B are sections along line 3A—3A and line 3B—3B, respectively, in FIG. 2 showing a state before the housings are connected, respectively.
Figure 4:
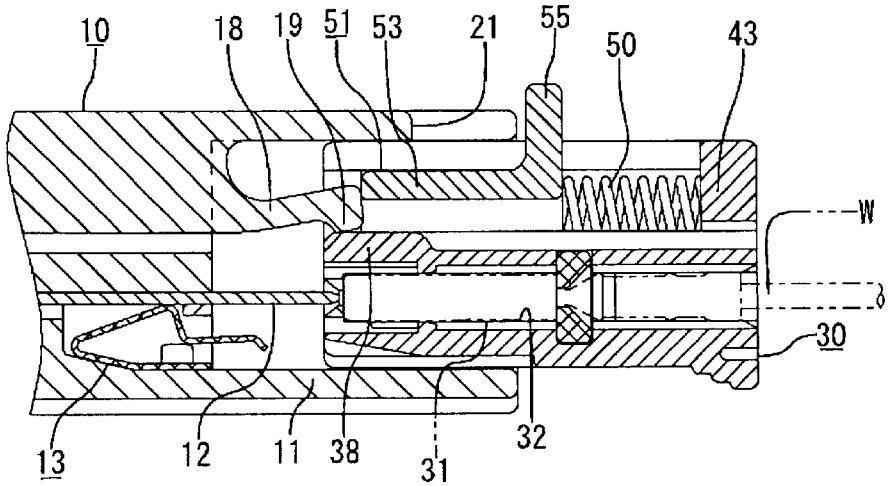
FIGS. 4A and 4B are a section along line 3A—3A showing a state where a lock arm is elastically deformed to engage a slider, and a section along line 3B—3B showing a state at an intermediate stage of connection of the housings, respectively.
Figure 4:
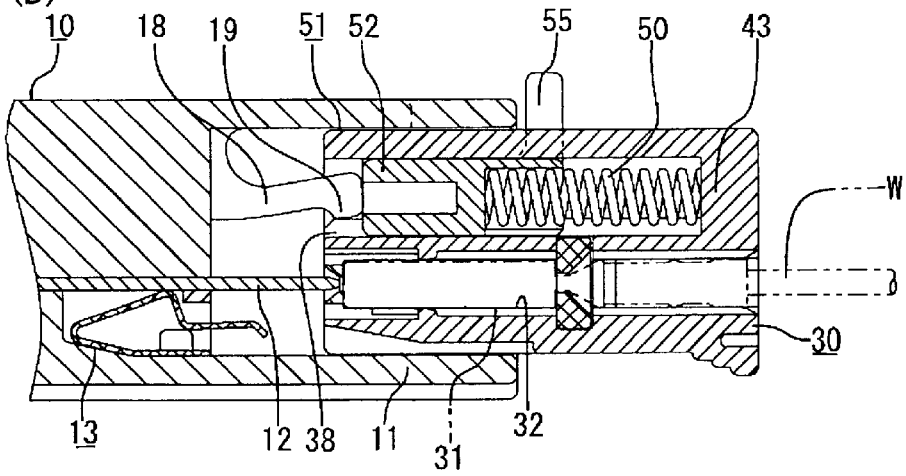
Figure 5:
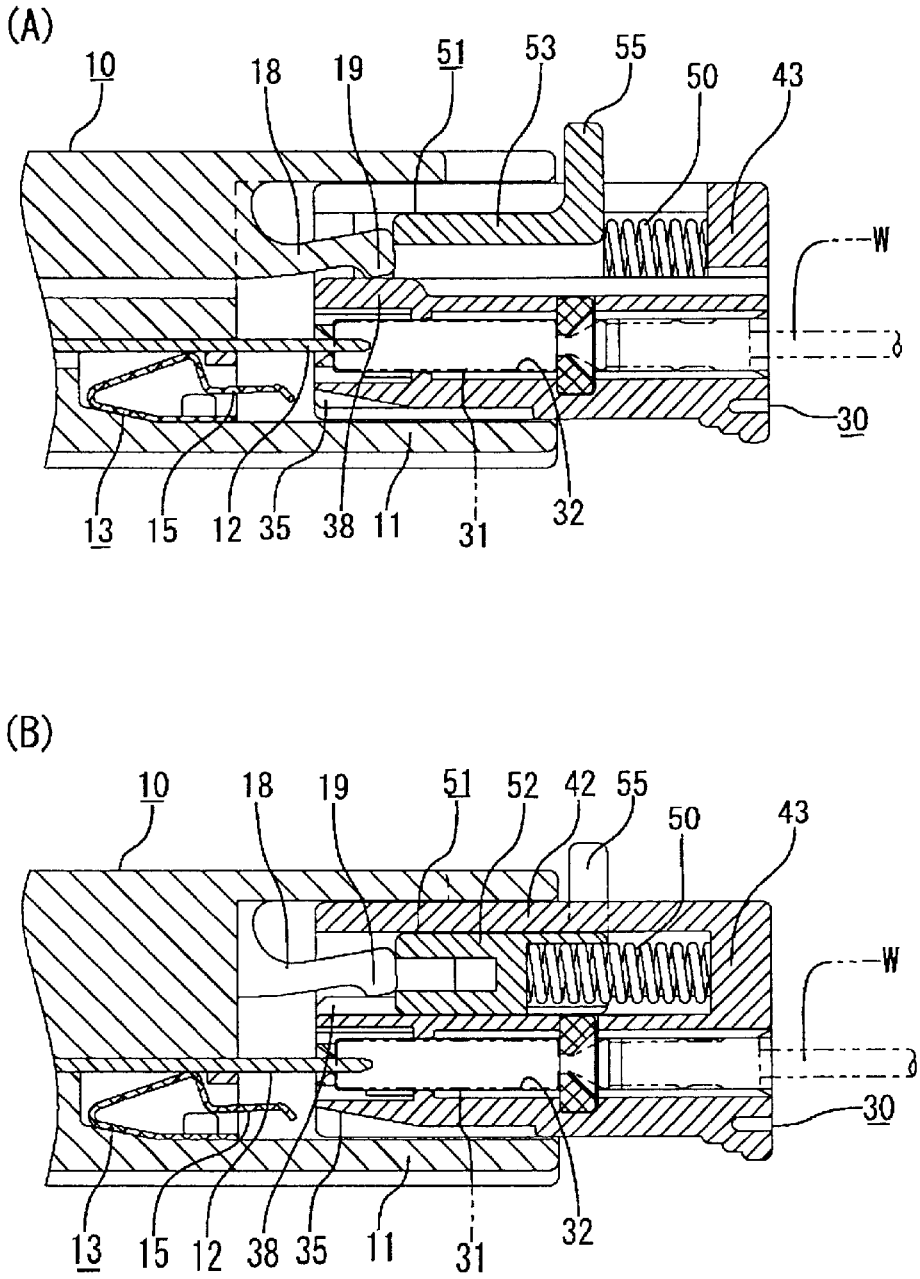
FIGS. 5A and 5B are a section along line 3A—3A showing a state where the slider is moved backward by being pushed by the lock arm, and a section along line 3B—3B showing a state where compression coil springs are elastically compressed, respectively.

A connector in accordance with the invention is comprised of a male housing 10 and a female housing 30, as shown in FIGS. 1–8. The housing 10, 30 are configured to be connected or disconnected with one another by movement along a connection and separating direction CSD, as shown in FIG. 3. The end of each housing 10, 30 that connects with the other housing 30, 10 is referred to herein as the front.

The male housing 10 is formed unitarily from a synthetic resin and preferably defines a substantially rectangular tube that projects forward from a piece of equipment. A receptacle 11 extends into the front end of the male housing 10 and a lock arm 18 projects forwardly in the receptacle 11. Male tab terminals 12 project forwardly into the receptacle 11 from a back wall of the male housing 10. the male tab terminals 12 preferably are arranged substantially side-by-side in a widthwise direction. A shorting terminal 13 is accommodated in the back wall of the male housing 10 below the male tab terminals 12. The shorting terminal 13 has a substantially plate-shaped main portion 14 and elastic contact pieces 15 folded from the rear end of the main portion 15 to project forward. The main portion 15 of the shorting terminal 13 is pressed into a mount groove 16 that is substantially flush with the inner surface of the receptacle 11. The elastic contact pieces 15 are accommodated in accommodating recesses 17 and face the respective male tab terminals 12. Thus, the elastic contact pieces 15 are held resiliently or elastically in contact with the respective male tab terminals 12. In this way, the male tab terminals 12 are shorted with each other, and a potential difference among the male tab terminals 12 is prevented. The elastic contact pieces 15 have front ends 15*a* that are bent down and away from the male tab terminals 12.

The lock arm 18 in the form of a cantilever projects substantially from a widthwise center position of the back wall of the male housing 10 above the male tab terminals 12 or on a side thereof opposing the shorting terminal 13. The lock arm 18 projects slightly more forward than the male tab terminals 12, and is elastically or resiliently deformable about its base end along a displacement direction D which intersects the connecting and separating direction CSD at an angle different from 0° or 180° and preferably a right angle. A hook 19 projects down at the free front end of the lock arm 18.

A notch 21 is formed in a widthwise center position at the front of the upper wall of the receptacle 11. The lock arm 18 is located behind the rear end surface of the notch 21 and is surrounded laterally by the walls of the receptacle 11. Opposite sides of the bottom of the receptacle 11 project down and define a pair of longitudinally extending guide recesses 22.

The female housing 30 is formed of a synthetic resin and defines a substantially block shape. The front end of the female housing 30 is configured for insertion into the receptacle 11 of the male housing 10. Female terminal fittings 31 are accommodated in cavities 32 that penetrate through the female housing 30 in forward and backward directions, and wires W are connected with the rear ends of the female terminal fittings 31. The female terminal fittings 31 are disposed and configured for mating with the male tab terminals 12 as the female housing 30 is urged into the receptacle 11 of the male housing 10. Additionally, the front end of the female housing 30 is configured to engage the bent leading ends 15*a* of the elastic contact pieces 15. Thus, the elastic contact piece 15 of the shorting terminal 13 are pushed elastically or resiliently away from the male tab terminals 12 as the female housing 30 is fit into the receptacle 11.

A retainer mount hole 33 is formed in one side of the female housing 30 and crosses the respective cavities 32. A retainer 34 is mountable in the retainer mount hole 33 and projects into the respective cavities 32 to directly lock the female terminal fittings 31.

Engaging recesses 35 are formed substantially side-by-side on the bottom front surface of the female housing 30 and are engageable with the respective bent leading ends 15*a* of the elastic contact pieces 15 of the shorting terminal 13 as the female housing 30 is inserted into the receptacle 11 of the male housing 10. Thus, the elastic contact pieces 15 can be deformed smoothly downward and away from the respective male terminals 12.

Guide ribs 36 project down at opposite sides of the bottom surface of the female housing 30. The guide ribs 36 enter the guide recesses 22 of the male housing 10 for guiding the connection of the housings 10, 30.

An operable rib 37 projects down from the rear end of the bottom surface of the female housing 30 and extends in the widthwise direction. The female housing 30 can be connected with and separated from the male housing 10 by gripping the operable rib 37.

Figure 6:
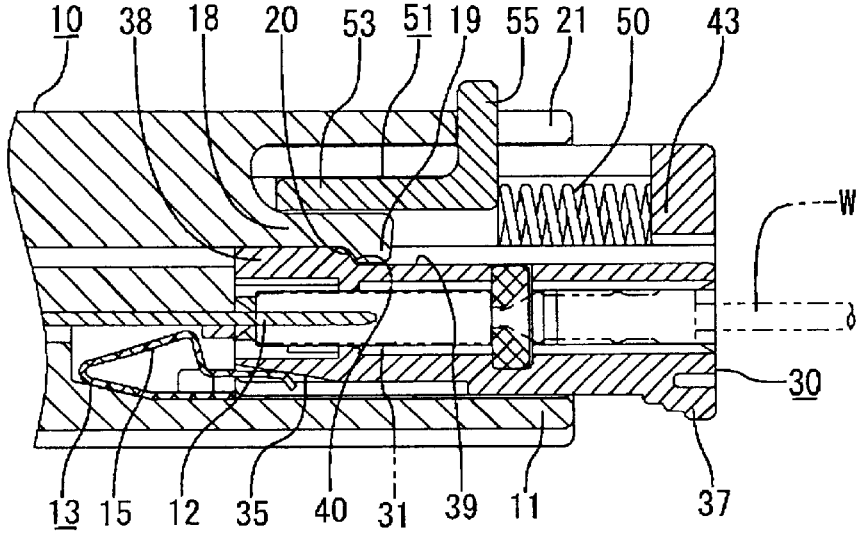
FIGS. 6A and 6B are sections along line 3A—3A and line 3B—3B showing a state where the housings are properly connected, respectively.
Figure 6:
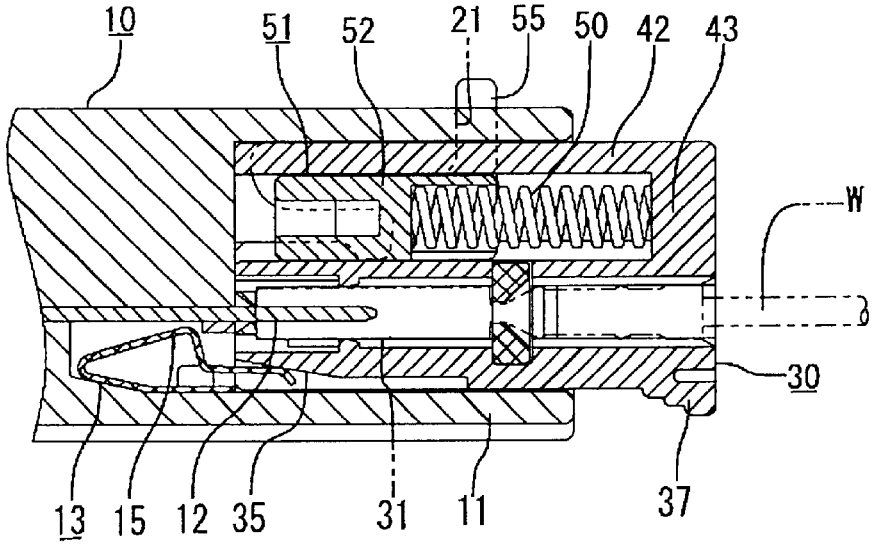
Figure 7:
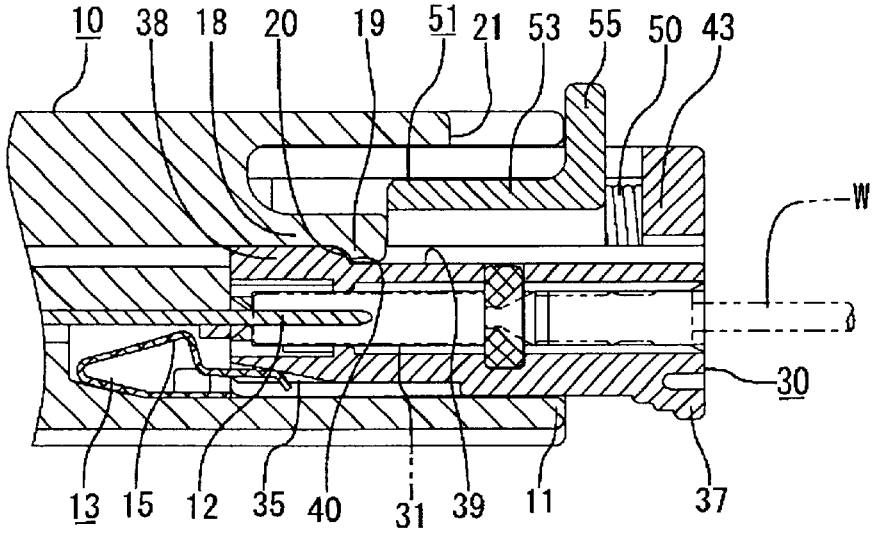
FIGS. 7A and 7B are a section along line 3A—3A showing a state where the slider is moved backward, and a section along line 3B—3B showing a state where the compression coil springs are elastically compressed, respectively.
Figure 7:
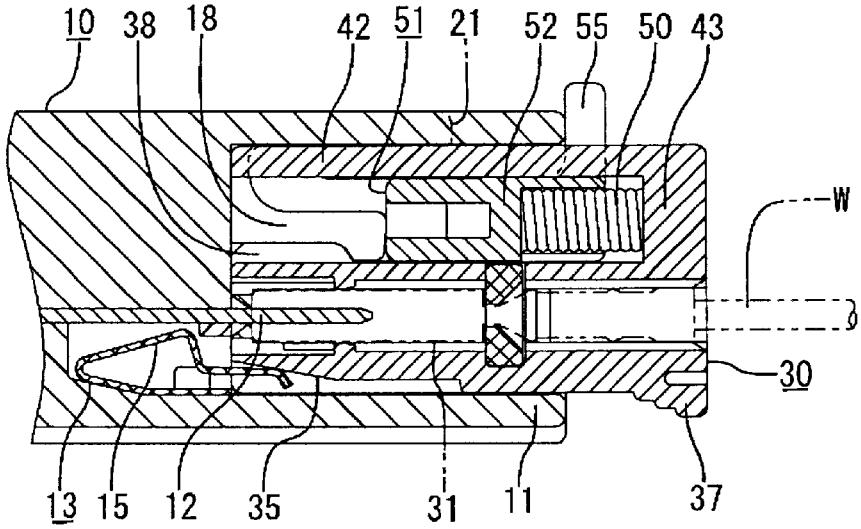

A bulging portion 38 is formed in the widthwise center of the upper surface of the female housing 30 and bulges up to a height for overlapping with the hook 19 and substantially aligning with the lower surface of an arm portion of the lock arm 18 of the male housing 10. An escape groove 39 is formed behind the bulging portion 38 for permitting the entrance of the hook 19 of the lock arm 18. The rear end surface 20 of the hook 19 of the lock arm 18 is engaged with the rear end surface 40 of the bulging portion 38 at front end of the escape groove 39, when the housings 10, 30 are connected properly, as shown in FIG. 6. The locking surfaces 20, 40 (rear end surfaces) of the hook 19 and the bulging portion 38 are sloped or rounded moderately upward to the left in FIGURES, to form a releasable locking construction. Thus, a specified force applied in a direction to separate the housings 10, 30 from each other causes the slanted or rounded locking surfaces 20, 40 to deflect the lock arm 18 up and out of the locked engagement with the bulging portion 38.

Two side walls 41 project up at opposite sides of the upper surface of the female housing 30 and two ceiling walls 42 project toward each other from the upper ends of the side walls 41. A rear wall 43 extends in the widthwise direction at the rear of the upper surface of the female housing 30 and is connected with the side walls 41 and the ceiling walls 42.

Two compression coil springs 50 and a slider 51 are assembled and inserted into a space surrounded by the side walls 41, the ceiling walls 42 and the rear wall 43. The assembly of the coil springs 50 and the slider 51 is movable in forward and backward or longitudinal directions substantially along the connecting direction of the housings 10, 30 and is guided by the upper surface of the female housing 30, the side edges of the bulging portion 38, the side walls 41 and the ceiling walls 42.

The slider 51 is formed e.g. of a synthetic resin and has two spring accommodating portions 52 connected by a coupling portion 53. As shown in FIG. 3B, rear parts of the spring accommodating portions 52 are recessed and accommodate front ends of the compression coil springs 50. The compression coil springs 50, in the condition shown in FIGS. 3A and 3B, are compressed slightly along their longitudinal direction between the spring accommodating portions 52 and the front end surface of the rear wall 43. However, the slider 51 can be moved backward from this state to deform the compression coil springs 50 for storing even larger spring forces (see FIG. 5B).

Two stopper projections 54 project sideways from the opposite side surfaces of the slider 51, as shown in FIG. 2. The stopper projections 54 are engaged in stopper grooves 44 formed in the side walls 41 and can be urged into engagement with front end surfaces of the stopper grooves 44 to limit a range of movement of the slider 51 in the stopper grooves 44. The front end surface of the slider 51 is retracted slightly from the front end surface of the female housing 30 when the stopper projections 54 are engaged at the front end surfaces of the stopper grooves 44.

The coupling portion 53 of the slider 51 has a lower surface substantially at the same height as the upper surface of the lock arm 18 in its undeflected state as shown in FIG. 3(A). Accordingly, the front end surface of the lock arm 18 is engageable with the front end surface of the coupling portion 53 when the lock arm 18 is deformed elastically or resiliently to displace its free end upward. The position of the lock arm 18 at this time is referred to as an engaging or first position and is shown in FIG. 5A. On the other hand, the position of the lock arm 18 where it is in its natural undeflected state and cannot be engaged with the front end surface of the coupling portion 53 of the slider 51 is referred to as a disengaging or second position. The coupling portion 53 of the slider 51 is located above the lock arm 18 substantially over its entire length when the housings 10, 30 are connected with each other. Hence, the coupling portion 53 of the slider 51 prevents the lock arm 18 from deflecting upwardly and out of engagement with the bulging portion 38 (see FIG. 6).

An operable portion 55 projects up from the upper surface at the rear end of the coupling portion 53. The operable portion 55 has a height sufficient to project out from the upper surface of the male housing 10 through the space between the ceiling walls 42 and the notch 21 of the male housing 10 with the housings 10, 30 connected with each other (see FIG. 6). Thus the operable portion 55 can be pushed to move the slider 51 back against the biasing forces of the compression coil springs 50. The operable portion 55 is held substantially in sliding contact with the respective side edges of the ceiling walls 42 and the notch 21 while the slider 51 is moved forward and backward.

The housings 10, 30 are connected with each other by first aligning the front ends of the housings 10, 30 with one another, as shown in FIG. 3, and then fitting the female housing 30 into the receptacle 11 of the male housing 10. The lock arm 18 engages the front end surface of the bulging portion 38 before the male tab terminals 12 enter the cavities 32 of the female housing 30. Thus, the lock arm 18 is deformed elastically or resiliently to the engaging or first position while moving onto the upper surface of the bulging portion 38. Thereafter, the front end surface of the lock arm 18 engages the front end surface of the coupling portion 53 of the slider 51 at the position slightly retracted from the front end surface of the bulging portion 38. If connection proceeds from this state, the terminal fittings 12, 31 start contacting and the lock arm 18 located in the engaging position shown in FIG. 5 pushes the slider 51 back. As a result, the slider 51 is moved back and the compression coil springs 50 are compressed elastically.

The connecting operation may be interrupted halfway. In such a case, the spring forces accumulated in the elastically compressed coil springs 50 are released. Thus, the slider 51 is biased forward and pushes the lock arm 18 to forcibly separate the housings 10, 30 from each other. This prevents the housings 10, 30 from being kept partly connected.

A continuation of the connecting operation causes the engaging recesses 35 of the female housing 30 engage the elastic contact pieces 15 of the shorting terminal 13. Thus, the elastic contact pieces 15 deform away from the male tab terminals 12, and the shorted state of the male tab terminals 12 is canceled (see FIG. 6).

Sufficient insertion of the female housing 30 into the male housing 10 causes the hook 19 to align with the escape groove 39, and enables the lock arm 18 to be restored resiliently to its disengaging or second position. As a result, the rear end surface 20 of the hook 19 engages the rear end surface 40 of the bulging portion 38 at the front end of the escape groove 39, as shown in FIG. 6. Simultaneously, the slider 51 disengages from the lock arm 18 and is moved forward by the released spring forces accumulated in the compression coil springs 50. Forward movement of the slider 51 is stopped by engagement of the stopper projections 54 with the front end surfaces of the stopper grooves 44 to define movement range limiting means. Therefore, the slider 51 is at the position it was at before the housings 10, 30 were connected. At this time, the lock arm 18 is in the disengaging position, and the coupling portion 53 of the slider 51 covers the lock arm 18 over substantially its entire length. Hence the coupling portion 53 of the slider 51 prevents the lock arm 18 from deforming upward. In this way, the housings 10, 30 are locked firmly together since the lock arm 18 and the bulging portion 38 are engaged and the slider 51 prevents the lock arm 18 from being deformed in the unlocking direction D. In this state, the operable portion 55 of the slider 51 is located in the notch 21 of the receptacle 11 and its front end surface is held in contact with or near the front end surface of the notch 21.

Figure 8:
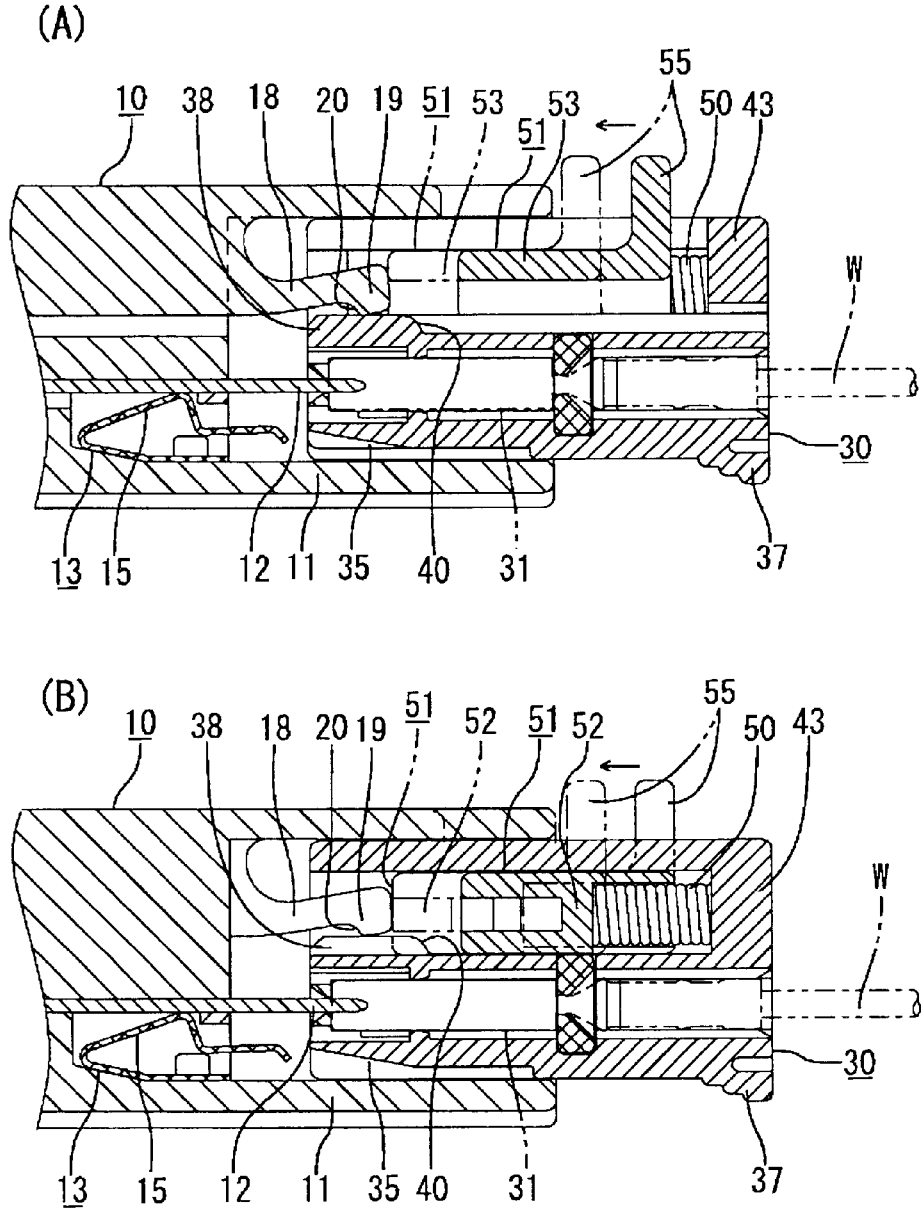
FIGS. 8A and 8B are sections along line 3A—3A and line 3B—3B showing an intermediate stage of separation, respectively.
Figure 9:
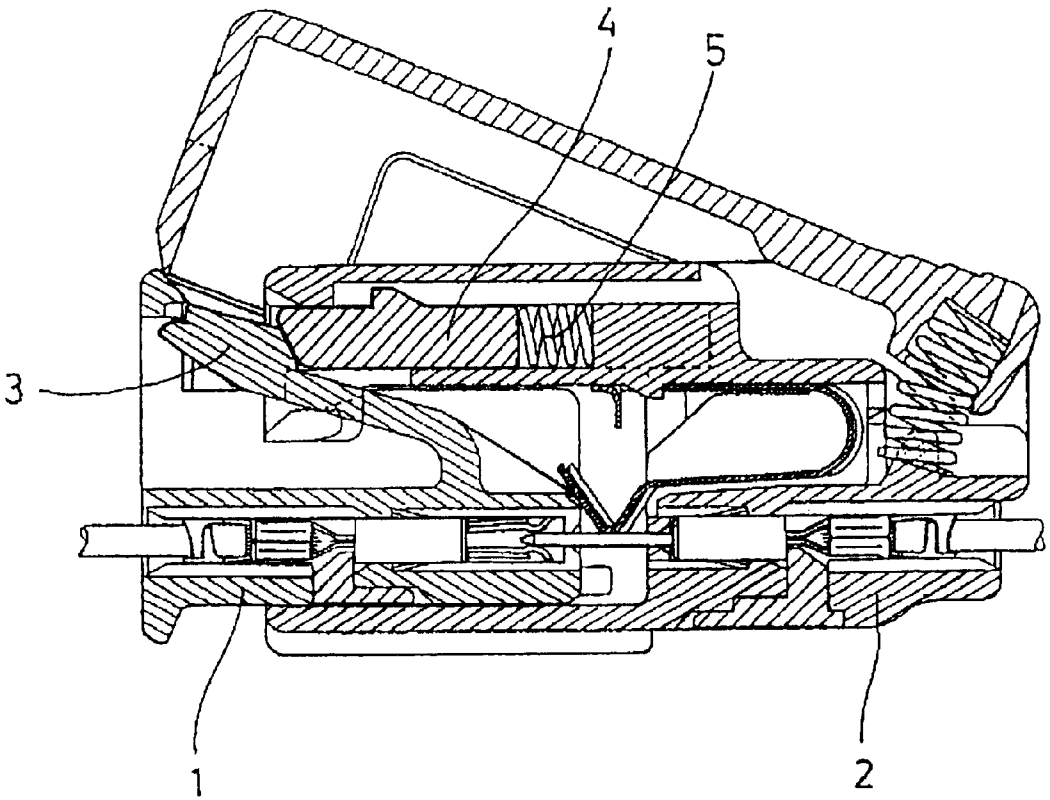
FIG. 9 PRIOR ART
FIG. 9 is a side view in section of a prior art connector.

The housings 10, 30 can be separated for maintenance or another reason by simultaneously gripping the operable portion 55 of the slider 51 and the rib 37 of the female housing 30 and pulling both away from the male housing 10. The female housing 30 initially will not move relative to the male housing 10. However, the pulling forces on the operable portion 55 cause the slider 51 to move back and against the forces of the compression coil springs 50. The slider 51 is moved back to a position where it is no longer above the lock arm 18. This is a position where the front end surface of the operable portion 55 is substantially flush with the front end surface of the receptacle 11. In this position, the slider 51 is no longer above the lock arm 18. Thus, the lock arm 18 deforms elastically upward due to the pulling force on the female housing 30 in separating direction and the ramp effect created by the slanted guide surfaces 20, 40 of the hook 19 and the bulging portion 38. As the female housing 30 is moved away from the male housing 10, the locking surfaces 20, 40 of the hook 19 and the bulging portion 38 disengage from each other, as shown in FIG. 8, and the female housing 30 is pulled out. During this process, the elastic contact pieces 15 of the shorting terminal 13 disengage from the engaging recesses 35 and move again into contact with the male tab terminals 12. The moving direction of the slider 51 and the pulling direction of the female housing 30 coincide. Hence, the separating operation can be performed easily.

The separating operation may be interrupted halfway. In such a case, the spring forces of the elastically compressed coil springs 50 are released and move the slider 51 forward against the front end surface of the lock arm 18, as illustrated in phantom in FIG. 8. As a result, the housings 10, 30 are separated forcibly from each other. On the other hand, the separating operation could be interrupted with the female housing 30 moved only slightly in separating direction from its connected state and with the lock arm 18 slightly deformed. In this situation, the slider 51 is biased by the coil springs 50 against the rounded portion 18*a* at the upper front end of the lock arm 18. Hence, the lock arm 18 is guided to its disengaging position and the housings 10, 30 are returned to the connected state. The separating operation then may be performed again. Thus, the housings 10, 30 are prevented from being kept partly connected during their separating operation.

As described above, partial connection of the housings 10, 30 can be detected both during a connecting operation and during a separating operation. Further, the lock arm 18 holds the housings 10, 30 in their locked condition and also engages the slider 51. Therefore the connector can be simplified as compared to a case where separate parts perform these two functions. Furthermore, the operable portion 55 for forcibly moving the slider 51 backward during the separating operation projects out from the outer contour of the connector. Thus, the separating operation can be performed easily.

The present invention is not limited to the above described and illustrated embodiment. For example, following embodiments are also embraced by the technical scope of the present invention as defined in the claims. Beside the following embodiments, various changes can be made without departing from the scope and spirit of the present invention as defined in the claims.

The compression coil springs are mounted behind the slider in the foregoing embodiment. However, they may be mounted before the slider according to the present invention.

Contrary to the foregoing embodiment, the slider and the compression coil springs may be mounted in the male housing and the lock arm may be provided at the female housing according to the present invention.

Although the male housing is integrally or unitarily formed with a piece equipment in the foregoing embodiment, the male housing may, for example, be provided at an end of a wire drawn from an equipment or may be an intermediate connector.

In the foregoing embodiment, the compression coil springs may be deleted e.g. if there is a demand to reduce production costs. In such a case, the connected state of the housings can be detected during the connecting operation based on whether the slider can be moved forward by constantly pushing the slider forward. On the other hand, by pulling the female housing in separating direction and pushing the slider forward after moving the slider backward up to a position where it is disengaged from the lock arm, it can be detected that the separating operation is halfway while the forward movement of the slider is restricted by its engagement with the lock arm.

What is claimed is:

1. A connector having first and second connector housings, the first and second connector housings having forward ends, the forward end of the first connector housing having a receptacle, the forward end of the second connector housing being insertable in and removable from the receptacle, the connector comprising:

a looking bulge formed on the second connector housing;

a lock arm cantilevered forwardly in the receptacle of the first connector housing, the look arm being resiliently displaceable between a first position and a second position, the lock arm being configured for engaging the locking bulge of the second connector housing when the lock arm is in the second position and when the first and second connector housings are fully connected;

a slider disposed in the second connector housing for movement between forward and backward positions, the slider having a front end configured for engagement with the lock arm when the lock arm is in the first position and a passage aligned with the locking bulge, such that wails defining said passage slide on opposite sides of the locking bulge, the passage being dimensioned to accommodate the lock arm when the lock arm is in the second position, the slider further being configured to prevent displacement of the lock arm from the second position when the housings are fully connected and when the slider is in the forward position, first and second spring accommodating portions disposed on opposite respective sides of the walls defining said passage; and first and second biasing means disposed respectively in the first and second spring accommodating portions, each of said biasing means extending between the slider and the second connector housing for biasing the slider toward the forward position, the first and second biasing means being disposed respectively on opposite respective sides of the passage of the slider.

2. The connector of claim 1, wherein the slider includes an operating portion projecting out of said housings for moving the slider rearwardly against biasing forces exerted by the biasing means.

3. The connector of claim 1, wherein the first connector housing further comprises a plurality of male terminals therein, the lock arm being resiliently displaceable toward and away from the male terminal fittings in the first connector housing.

4. The connector of claim 1, wherein the receptacle of the first connector housing has a rear wall, the lock arm being cantilevered forwardly from the rear wall toward the forward end of the first connector housing, the receptacle being open at the forward end of the first connector housing and having a plurality of interconnected side walls extending forwardly from the rear wall to the forward end of the first connector housing, the side walls surrounding the lock arm and being spaced outwardly therefrom.

5. The connector of claim 4, wherein the lock arm is formed unitarily with a hook at an end thereof furthest from the rear wall of the receptacle, the hook being configured for engaging the second connector housing.

6. The connector of claim 1, wherein the locking bulge is dimensioned and disposed to deflect the lock arm to the first position during connection of the first and second connector housings and being configured for engagement by the lock arm when the lock arm is in the second position and when the first and second connector housings are fully connected.

7. The connector of claim 6, wherein the second connector housing is insertable in and removable from the receptacle along connection and separating directions, the first and second biasing means being on opposite respective sides of the locking bulge in the second connector housing and aligned substantially parallel to the connection and separating direction.

8. A connector comprising:

a first housing having opposite front and rear ends and opposite first and second sides, a locking bulge on an external surface of the first housing in proximity to the front end and substantially centrally between the first and second sides, a locking surface facing rearwardly on the locking bulge;

a slider assembled with the first housing for movement between front and rear positions, the slider having first and second spring accommodating portions formed by walls of said slider slidably disposed on opposite sides of the looking bulge of the first housing, a coupling portion extending between the first and second spring accommodating portions and being spaced from the locking bulge, such that a passage is defined between the spring accommodating portions and between the locking bulge and the coupling portion;

first and second spaced apart springs disposed between the first housing and the slider and in the respective first and second spring accommodating portions, such that the springs are disposed on opposite respective sides of the passage, the first and second springs each having an axis, the axes of said springs being substantially parallel to one another and defining a plane; and a second housing having a front end and a receptacle extending into the front end, the receptacle being configured to receive at least the front ends of the first housing and the slider, a resilient engaging portion projecting forwardly in the receptacle and disposed to be engaged by the locking bulge during insertion of the first housing and the slider into the receptacle, the resilient engaging portion being insertable between the springs and between portions of the slider and the first housing when the slider is in the rear position, the resilient engaging portion further being configured to return resiliently toward an undeflected condition and into engagement with the locking surface of the locking bulge after complete insertion of the first housing into the receptacle, the deflection of the resilient engaging portion being in a plane substantially orthogonal to the plane defined by the axes of the springs.

9. The connector of claim 8, wherein the resilient engaging portion has a hook unitarily formed at an end thereof closest to the front end of the second housing, the hook being configured and dimensioned for engaging the locking surface of the locking bulge after complete insertion of the first housing into the receptacle.

10. The connector of claim 9, wherein the slider is configured to be engaged by the resilient engaging portion when the resilient engaging portion is deflected during insertion of the first housing and the slider into the receptacle, such that the resilient engaging portion urges the slider rearwardly and against the biasing force exerted by the springs.

11. The connector of claim 10, wherein the slider is configured to be propelled to the front position by the spring when the resilient engaging portion returns to the undeflected condition and into engagement with the locking surface of the lock after complete insertion of the first housing into the receptacle, the slider further being configured to prevent deflection of the resilient engaging portion away from the locking surface when the slider is in the front position and when the first housing is completely inserted into the receptacle.

12. A connector comprising:

a first housing having opposite front and rear ends, a locking bulge on an external surface of the first housing in proximity to the front end, a locking surface facing rearwardly on the locking bulge;

a slider assembled with the first housing for movement between front and rear positions, the slider having first and second spring accommodating portions disposed on opposite respective sides of said locking bulge and a coupling portion extending between said spring accommodating portions and in spaced relationship to said locking bulge such that a passage is defined between said first and second spring accommodating portions and between said coupling portion and said locking bulge of said first housing;

first and second spaced apart springs on opposite respective sides of said passage and extending between the respective first and second spring accommodating portions and the first housing for urging the slider toward the front position; and a second housing having a front end and a receptacle extending into the front end, the receptacle being configured to receive at least the front ends of the first housing and the slider, a resilient engaging portion projecting forwardly in the receptacle and disposed to be engaged by the locking bulge during insertion of the first housing and the slider into the receptacle, the resilient engaging portion being deflectable by the engagement of the locking bulge into engagement with the coupling portion of the slider for urging the slider into the rear position, the resilient engaging portion further configured to return resiliently toward an undeflected condition and into engagement with the locking surface of the locking bulge after complete insertion of the first housing into the receptacle.

13. The connector of claim 12, wherein the coupling portion of the slider is dimensioned to be slid over the resilient engaging portion when the resilient engaging portion is in the undeflected condition and In engagement with the locking surface of the locking bulge.

14. A connector comprising:

a first housing having opposite front and rear ends, a locking bulge on an external surface of the first housing in proximity to the front end, a locking surface facing rearwardly on the locking bulge;

a slider assembled with the first housing for movement between front and rear positions, the slider having first and second spring accommodating portions disposed on opposite respective sides of said locking bulge and a coupling portion extending between said spring accommodating portions, the coupling portion being in opposed spaced relationship to said locking bulge when said slider is in said front position and being rearward of the locking bulge when said slider is in said rear position such that a passage is defined between the coupling portion and portions of the external surface of the first housing aligned with the locking bulge; and first and second spaced apart springs on opposite respective sides of said passage and extending between the respective first and second spring accommodating portions and the first housing for urging the slider toward the front position.

* * * * *